US008994624B2

(12) United States Patent
Cho et al.

(10) Patent No.: US 8,994,624 B2
(45) Date of Patent: Mar. 31, 2015

(54) POWER SUPPLYING APPARATUS, POWER SUPPLYING METHOD, ORGANIC LIGHT-EMITTING DIODE DISPLAY APPARATUS

(71) Applicant: Samsung Electronics Co., Ltd., Suwon-si (KR)

(72) Inventors: Eun-il Cho, Suwon-si (KR); Joon-hyun Yang, Suwon-si (KR); Byeong-cheol Hyeon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 175 days.

(21) Appl. No.: 13/725,380

(22) Filed: Dec. 21, 2012

(65) Prior Publication Data

US 2013/0169517 A1 Jul. 4, 2013

(30) Foreign Application Priority Data

Dec. 28, 2011 (KR) ..... 10-2011-0145313
Dec. 30, 2011 (KR) ..... 10-2011-0147497
Apr. 24, 2012 (KR) ..... 10-2012-0042798

(51) Int. Cl.
*G09G 3/30* (2006.01)
*G09G 3/36* (2006.01)
*G09G 3/32* (2006.01)

(52) U.S. Cl.
CPC ..... *G09G 3/3696* (2013.01); *G09G 3/3208* (2013.01); *G09G 2330/021* (2013.01); *G09G 2330/022* (2013.01); *G09G 2330/027* (2013.01); *G09G 2330/028* (2013.01)
USPC ..... 345/77; 345/76; 345/211; 345/212

(58) Field of Classification Search
USPC ..... 345/76–83, 204–214, 690–699
See application file for complete search history.

(56) References Cited

U.S. PATENT DOCUMENTS

| | | | | |
|---|---|---|---|---|
| 8,730,228 | B2 * | 5/2014 | Yonemaru et al. | 345/212 |
| 2005/0140604 | A1 * | 6/2005 | Shin | 345/76 |
| 2008/0218503 | A1 * | 9/2008 | Lee | 345/211 |
| 2008/0246751 | A1 * | 10/2008 | Lee | 345/212 |
| 2009/0147553 | A1 | 6/2009 | Ryu et al. | |
| 2011/0057960 | A1 * | 3/2011 | Kim et al. | 345/690 |
| 2011/0096052 | A1 * | 4/2011 | Kim | 345/211 |
| 2011/0096063 | A1 * | 4/2011 | Kim | 345/212 |

FOREIGN PATENT DOCUMENTS

EP 2257122 A1 12/2010

OTHER PUBLICATIONS

Communication from the European Patent Office issued Apr. 18, 2013 in counterpart European Application No. 12196647.7.

* cited by examiner

*Primary Examiner* — Dmitriy Bolotin
(74) *Attorney, Agent, or Firm* — Sughrue Mion, PLLC

(57) ABSTRACT

A power supplying apparatus, a power supplying method, an organic light-emitting diode (OLED) display apparatus are provided. The OLED display apparatus includes: a plurality of components which are to perform an operation of the OLED display apparatus; a power supplying unit; a rectifier which rectifies an input voltage supplied from the power supplying unit; and a voltage level converter which converts a level of the input voltage rectified by the rectifier and supplies the input voltage having the converted level to the plurality of components.

16 Claims, 8 Drawing Sheets

POWER SUPPLYING APPARATUS, POWER SUPPLYING METHOD, ORGANIC LIGHT-EMITTING DIODE DISPLAY APPARATUS

CROSS-REFERENCE TO RELATED APPLICATIONS

This application claims priority under 35 U.S.C. §119 from Korean Patent Application Nos. 10-2011-145313, filed on Dec. 28, 2011; 10-2011-147497, filed on Dec. 30, 2012; and 10-2012-0042798, filed on Apr. 24, 2012, in the Korean Intellectual Property Office, the disclosures of which are incorporated herein by reference in their entirety.

BACKGROUND

1. Field

Apparatuses and methods consistent with exemplary embodiments relate to a power supplying apparatus, a power supplying method, an organic light-emitting diode (OLED) display apparatus, and more particularly, to a display apparatus including an OLED and a method of supplying power thereto.

2. Description of the Related Art

The development of electronic technology has brought the development and supply of various types of electronic products. In particular, various types of display apparatuses, such as a TV, a portable phone, a personal computer (PC), a notebook PC, a personal digital assistant (PDA), etc., are used in most general homes.

A conventional display apparatus displays various types of images by using a liquid crystal display (LCD). The conventional LCD is not a self-emission display apparatus and thus uses a backlight unit as a light source.

In general, a display apparatus rectifies a commercial voltage of 110 V or 220 V applied from an external source and supplies the rectified commercial voltage to power consumption parts of the display apparatus. Since a backlight unit requires a driving voltage higher than the other power consumption parts, the display apparatus is to separately include a main DC-DC converter which is to supply power to the backlight unit and a sub DC-DC converter which is to supply power to the other parts.

Therefore, a conventional LCD requires additional cost, and the display apparatus is limitedly made slim and light. Also, the conventional LCD requires backlight and thus is heavy and thick and has a slow response speed.

An organic light-emitting display has been developed as a next generation image display apparatus replacing an LCD. The organic light-emitting display displays an image by using organic light-emitting diodes (OLEDs) which emit light through a recombination of electrons and holes.

Here, each of the OLEDs of the organic light-emitting display includes an anode, a cathode, and an emission layer formed between the anode and the cathode. Also, if a current flows from the anode to the cathode, the emission layer emits light, and an amount of the light varies according to changes of an amount of the current, thereby representing luminance.

The organic light-emitting display using the above-described OLEDs has a high color representation and a thin thickness. Therefore, the organic light-emitting display has wide application in a portable phone, a PDA, an MP3 player, etc.

A method of driving the organic light-emitting display using the OLEDs is greatly classified into a passive matrix method and an active matrix method. The passive matrix method refers to a method of orthogonally forming an anode and a cathode and applying a current to selected cathode and anode lines to drive the anode and the cathode. The active matrix method refers to a method of integrating a thin film transistor (TFT) and a capacitor into each pixel to maintain a voltage due to a capacitance of the capacitor.

A process of driving an organic light-emitting display including general OLED pixels by using an active matrix method will now be described with reference to FIG. 1.

FIG. 1 is a circuit diagram illustrating a process of driving a conventional organic light-emitting display by using an active matrix method.

Referring to FIG. 1, the conventional organic light-emitting display includes OLEDs each including scan lines SL and data lines DL which cross each other, a switching transistor T1, a driving transistor T2, and a capacitor C. The switching transistor T1 includes a gate which is connected to the scan lines SL and a source which is connected to the data lines DL. The driving transistor T2 includes a gate which is connected to a drain of the switching transistor T1 and a source which is connected to a first power source ELVDD. The capacitor C is formed between the source and the gate of the driving transistor T2. A drain and an anode of the driving transistor T2 are connected to each other, and the source is connected to a second power source ELVSS.

A circuit operation of the organic light-emitting display will now be described. If the switching transistor T is turned on, a data voltage is applied to a gate electrode of the driving transistor T2. Also, a current flows in the OLED through the driving transistor T2 due to the data voltage to emit and display light. In addition, the data voltage applied to the gate electrode is maintained for a predetermined time due to the capacitor C.

An OLED as described above has low voltage and high current characteristics. Therefore, if a conventional power supply unit (e.g., a switch mode power supply (SMPS)) is applied, high power efficiency is not achieved.

SUMMARY

Exemplary embodiments address at least the above problems and/or disadvantages and other disadvantages not described above. Also, the exemplary embodiments are not required to overcome the disadvantages described above, and an exemplary embodiment may not overcome any of the problems described above.

The exemplary embodiments provide a display apparatus which applies a voltage having the same level to a display panel having an organic light-emitting diode (OLED) and other power consumption parts and a method of supplying power thereto.

The exemplary embodiments also provide a power supplying apparatus which controls turning on/off of a power factor correction (PFC) unit in a data voltage charging section and a light emitting section to improve power efficiency, a power supplying method, and a display apparatus.

According to an aspect of exemplary embodiments, there is provided an organic light-emitting diode (OLED) display apparatus including: a plurality of components which are to perform an operation of the OLED display apparatus; a power supplier; a rectifier which rectifies an input voltage supplied from the power supplying unit; and a voltage level converter which converts a level of the input voltage rectified by the rectifier and supplies the input voltage having the converted level to the plurality of components.

The rectifier may include a power factor correction (PFC) unit which corrects a power factor of the input voltage.

The voltage level converter may convert a level of a direct current (DC) voltage output from the PFC unit into a voltage level for driving a display panel and may supply the DC voltage having the voltage level to the plurality of components.

The display panel may include a plurality of pixels including OLEDs.

The OLED display apparatus may further include a controller which controls the PFC unit to be turned on/off according to operation states of the plurality of components.

The controller may turn off the PFC unit when the display panel performs a data voltage charging operation and turn on the PFC unit when the display panel performs a light emitting operation.

The controller may detect a level of the DC voltage supplied to the display panel, and if the detected level of the DC voltage is a first voltage level, determine that the display panel performs the data voltage charging operation to turn off the PFC unit, and if the detected level of the DC voltage is a second voltage level, determine that the display panel performs the light emitting operation to turn on the PFC unit.

The controller may turn on the PFC unit before a preset time based on a time when a data voltage charging operation ends.

If an output voltage of the PFC unit is lower than or equal to a preset level when the PFC unit is turned off, the controller may determine that the preset time has elapsed and turn on the PFC unit.

The OLED display apparatus may further include: a scan driver which supplies a scan signal to the plurality of pixels; a data driver which supplies a data signal to the plurality of pixels; and a voltage driver which supplies a driving voltage to the display panel.

The plurality of components may include at least one from among a display panel, an audio amplifier, a communication interface module, and a sub Micom.

According to another aspect of exemplary embodiments, there is provided a power supplying apparatus which supplies power to a display panel comprising a plurality of pixels comprising OLEDs. The power supplying apparatus may include: a power factor correction (PFC) unit which corrects a power factor of an input voltage; a DC-DC converter which converts a level of a DC voltage output from the PFC unit and supplies the DC voltage having the converted level to the display panel; and a controller which controls the PFC unit to be turned on/off according to an operation state of the display panel.

The controller may turn off the PFC unit when the display panel performs a data voltage charging operation but turn on the PFC unit when the display panel performs a light emitting operation.

The controller may detect a level of the DC voltage supplied to the display panel, and if the detected level of the DC voltage is a first voltage level, determines that the display panel performs the data voltage charging operation to turn off the PFC unit, and if the detected level of the DC voltage is a second voltage level, determine that the display panel performs the light emitting operation to turn on the PFC unit.

The controller may turn on the PFC unit before a preset time based on a time when a data voltage charging operation ends.

If an output voltage of the PFC unit is lower than or equal to a preset level when the PFC unit is turned off, the controller may determine that the preset time has elapsed and turn on the PFC unit.

According to another aspect of the exemplary embodiments, there is provided a method of supplying power to a display panel comprising a plurality of pixels comprising OLEDs. The method may include: correcting a power factor of an input voltage by using a power factor correction (PFC) unit; converting a level of a DC voltage output through the correction and supplying the DC voltage having the converted level to the display panel; and turning on/off the PFC unit according to an operation state of the display panel.

The turning on/off of the PFC unit may include: turning off the PFC unit when the display panel performs a data voltage charging operation; and turning on the PFC unit when the display panel performs a light emitting operation.

The turning on/off of the PFC unit may further include: detecting a level of the direct current (DC) voltage supplied to the display panel, wherein if the detected level of the DC voltage is a first voltage level, a determination is made that the display panel performs the data voltage charging operation to turn off the PFC unit, and if the detected level of the DC voltage is a second voltage level, a determination is made that the display panel performs the light emitting operation to turn on the PFC unit.

The PFC unit may be turned on before a preset time based on a time when a data voltage charging operation ends.

If an output voltage of the PFC unit is lower than or equal to a preset level when the PFC unit is turned off, a determination may be made that the output voltage.

According to various exemplary embodiments, a voltage having the same level may be applied to a display panel including OLEDs and other power consumption parts by using one DC-DC converter in order to drive modules of a display apparatus. Also, a PFC unit may be controlled to be turned on/off in a data voltage charging section and a light-emitting section to improve power efficiency.

BRIEF DESCRIPTION OF THE DRAWINGS

The above and/or other aspects will be more apparent by describing certain exemplary embodiments with reference to the accompanying drawings, in which:

FIG. 3 is a timing diagram illustrating an operation characteristic of a power factor correction (PFC) unit according to an exemplary embodiment of;

DETAILED DESCRIPTION OF EXEMPLARY EMBODIMENTS

Figure 1:
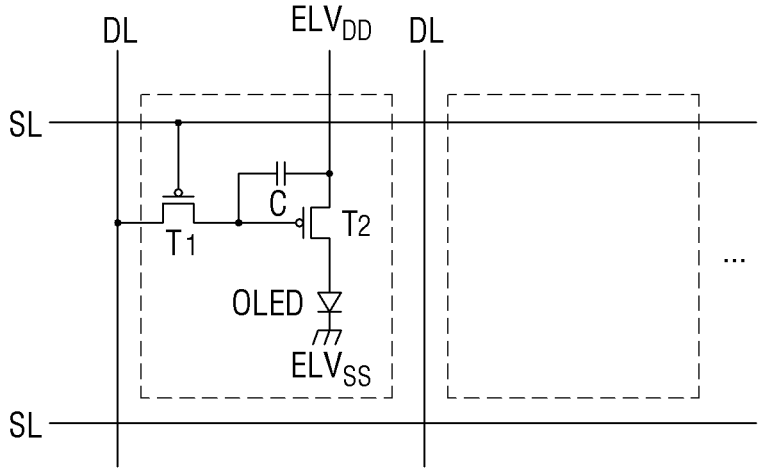
FIG. 1 is a circuit diagram illustrating a process of driving a conventional organic light-emitting display by using an active matrix method.

Exemplary embodiments are described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

Figure 2:
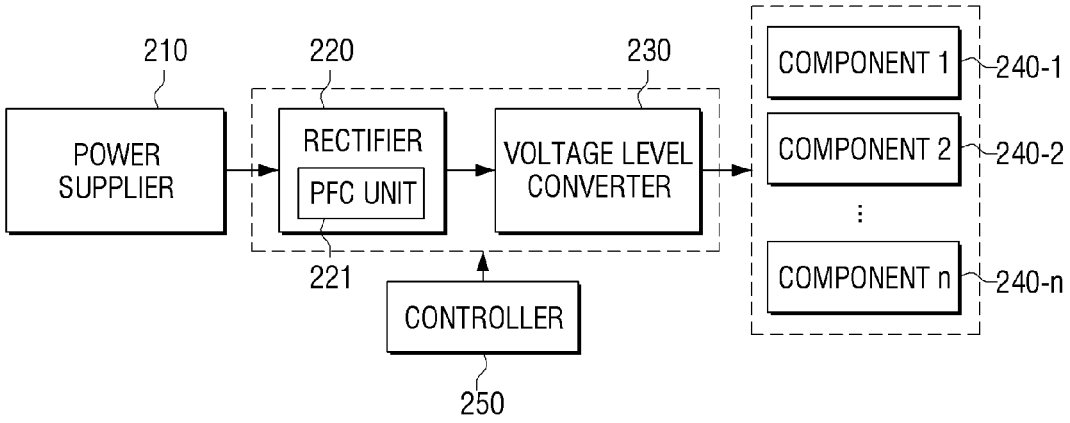
FIG. 2 is a block diagram of an organic light-emitting diode (OLED) display apparatus according to an exemplary embodiment.

FIG. 2 is a block diagram of an organic light-emitting diode (OLED) display apparatus according to an exemplary embodiment.

Referring to FIG. 2, the OLED display apparatus includes a power supplier 210, a rectifier 220, a voltage level converter 230, and a plurality of components 240-1, 240-2, . . . , and 240-n. The OLED display apparatus may be realized as various types of apparatuses having display units like a TV, a portable phone, a personal digital assistant (PDA), a notebook PC, a monitor, a tablet PC, an electronic book (e-book), an electronic frame, a kiosk, etc.

The power supplier 210 supplies a voltage for driving the OLED display apparatus. The power supplier 210 may supply power to the components 240-1, 240-2, . . . , and 240-n of the OLED display apparatus by using an alternating current (AC) voltage input from an external source.

The rectifier 220 rectifies an input voltage supplied from the power supplier 210. In detail, the rectifier 220 rectifies the AC voltage input from the power supplier 210 into a direct current (DC) voltage and transmits the DC voltage to the voltage level converter 230. The rectifier 220 may include a rectifier circuit (not shown) and a power factor correction (PFC) unit 221. In other words, the rectifier 220 corrects a power factor of the input voltage, which is the AC voltage input from the power supplier 210, through the rectifier circuit and the PFC unit 221. In detail, if the AC voltage is input from the power supplier 210, the rectifier circuit rectifies the input AC voltage into the DC voltage. The PFC unit 221 may correct the power factor of the rectified DC voltage and output the DC voltage having the corrected power factor to the voltage level converter 230, and an output of the PFC unit 221 may be about 400 V.

In addition, the PFC unit 221 is added as a power saving circuit to improve efficiency of power supplied to the OLED display apparatus and may adjust power supplied to components such as a transformer, a stabilizer, etc. which may instantaneously leak power. In other words, the PFC unit 221 may reduce power consumption and prevent a temperature from rising due to a change of a current into heat to improve power efficiency. In detail, the PFC unit 221 may include an inductor, a diode, a capacitor, and a switching means. Here, the inductor and the capacitor may be respectively connected to both ends of the diode, and the switching means may be connected to a contact node between the inductor and the diode. The switching means may be used as a transistor. A detailed circuit diagram of the PFC unit 221 is a well-known technology, and thus its detailed description and circuit diagram will be omitted in the present exemplary embodiment. Also, the PFC unit 221 may be a boost topology.

The voltage level converter 230 converts a level of the input voltage rectified by the rectifier 220, i.e., a level of the DC voltage, and commonly supplies the input voltage to the plurality of components 240-1, 240-2, . . . , and 240-n. The voltage level converter 230 may include a DC-DC converter (not shown) and thus may convert the DC voltage input from the rectifier 220 into a DC voltage having a preset level through the DC-DC converter and output the DC voltage having the preset level.

In detail, the voltage level converter 230 may convert the DC voltage input from the rectifier 220 into a voltage level for driving a display panel and commonly provide the voltage level to the components 240-1, 240-2, . . . , and 240-n. Here, the display panel may include a plurality of pixels having self-emission elements. Here, the self-emission elements may be realized as organic light-emitting diodes (OLEDs).

In general, an organic light-emitting display uses OLEDs using a light emission of an organic material and may drive N*M organic light-emitting cells arranged in a matrix by using a voltage or a current to display an image. Here, the organic light-emitting cells have diode characteristics and thus are referred to as OLEDs, and have structures of anodes, organic thin film transistors (TFTs), and cathode electrode layers. The OLEDs may be driven at a low driving voltage between about 12V and about 15V. Therefore, a voltage level for driving a display panel according to the present exemplary embodiment may be a voltage level (between 12V and 15V) for driving OLEDs forming pixels of the display panel. In other words, the voltage level converter 230 equally supplies a DC voltage having a voltage level for driving the OLEDs to the plurality of components 240-1, 240-2, . . . , and 240-n.

The plurality of components 240-1, 240-2, . . . , and 240-n operate the OLED display apparatus, e.g., may include at least one from among a display panel, an audio amplifier, an interface module, a communication interface module, and a sub Micom.

According to another exemplary embodiment , the OLED display apparatus may further include a controller 250 which controls overall operations of elements of the OLED display apparatus. The controller 250 controls turning on/off of the PFC unit 221 of the rectifier 220 according to operation states of the plurality of components 240-1, 240-2, . . . , and 240-n. In detail, when the display panel performs a data voltage charging operation, the controller 250 may turn off the PFC unit 221. When the display panel performs a light emitting operation, the controller 250 may turn on the PFC unit 221.

The controller 250 detects a level of the DC current supplied to the display panel and, if the detected level of the DC voltage is a first voltage level, determines that the display panel performs the data voltage charging operation in order to turn off the PFC unit 221. If the detected level of the DC voltage is a second voltage level, the controller 250 determines that the display panel performs the light-emitting operation in order to turn on the PFC unit 221.

Here, a data voltage charging section in which the display panel performs the data voltage charging operation may be a section in which a scan driver 280 of a display apparatus that is the organic light-emitting display supplies a scan signal through a plurality of scan lines S1, S2, . . . , and Sn to turn on a switching transistor T1 and a data driver 270 of the display apparatus supplies a data signal through a plurality of data lines D1, D2, . . . , and Dm to charge a capacitor C included in a plurality of pixels. Here, the capacitor C stores the supplied data signal as a data voltage.

A voltage ELVDD supplied from the voltage level converter 230 to the plurality of pixels of the display panel for the data voltage charging section may be the first voltage level. A light-emitting section in which the display panel performs the light-emitting operation may be a section in which the scan driver 280 of the display apparatus which is the organic light-emitting display cuts the scan signal supplied through the plurality of scan lines S1, S2, . . . , and Sn and supplies a voltage having a predetermined level through the voltage ELVDD to allow a driving transistor T2 to generate a driving current corresponding to the data voltage stored in the capacitor C and a threshold voltage in order to emit light from the OLEDs emit. Here, the OLEDs emit the light in response to the driving current.

The voltage ELVDD supplied from the voltage level converter 230 to the plurality of pixels of the display panel may be a second voltage level. In other words, the controller 250 may detect a level of the voltage ELVDD output from the voltage level converter 230 and, if the detected level of the voltage ELVDD is the first voltage level, determine that the voltage ELVDD is in the data voltage charging section. Also, the controller 250 may detect the level of the voltage ELVDD output from the voltage level converter 230 and, if the detected level is the second voltage level, may determine that the voltage ELVDD is in the light-emitting section.

If the controller 250 determines that the voltage ELVDD is in the data voltage charging section as described above, the controller 250 may turn off the PFC unit 221. If the controller 250 determines that the voltage ELVDD is in the light-emitting section, the controller 250 may turn off the PFC unit 221. In other words, the controller 250 may control a switching element of the PFC unit 221 to control turning on/off of the PFC unit 221.

The controller 250 may turn off the PFC unit 221 in the data voltage charging section to obtain a gain by power consumed by the PFC unit 221 for the data voltage charging section. As described above, according to an exemplary embodiment, a current is not supplied to the OLEDs in the data voltage charging section but is supplied to the OLEDs only in the light-emitting section. Therefore, the PFC unit 221 operates even in the data voltage charging section to solve a problem of a conventional display apparatus which generates an unnecessary loss of power.

According to another exemplary embodiment, the controller 250 may turn on the PFC unit 221 before a preset time based on a time when the data voltage charging section ends. In other words, the controller 250 turns off the PFC unit 221 of the rectifier 220 for the data voltage charging section. In this case, the PFC unit 221 may include the capacitor C and thus may supply the voltage level converter 230 with a voltage with which the capacitor C has been charged. Therefore, a level of the charging voltage of the PFC unit 221 is reduced. The PFC unit 221 is turned on in the light-emitting section, and thus a time required to reach a preset voltage level may be checked through an output of the PFC unit 221. Therefore, the controller 250 may turn on the PFC unit 221 before the preset time (i.e., before a time when a voltage level reaches a preset level at a starting time of the light-emitting section) from the time when the data voltage charging section ends.

According to another exemplary embodiment, if an output voltage of the PFC unit 221 is lower than or equal to a preset level when the PFC unit 221 is turned off, the controller 250 may determine that a preset time has elapsed and turn on the PFC unit 221. In detail, if the output voltage of the PFC unit 221 is lower than or equal to a preset level Vmin for the data voltage charging section, power efficiency of the voltage level converter 230, which has turned off the PFC unit 221, may be lower than efficiency of power passing through the voltage level converter 230 when the PFC unit 221 is turned on. Therefore, if the output voltage of the PFC unit 221 is lower than or equal to the preset level Vmin, the PFC unit 221 may be switched to a turned-on state according to a control command of the controller 250.

The elements of the display apparatus according to an exemplary embodiment have been described in detail. An operation characteristic of the PFC unit 221 will now be described in detail with reference to FIG. 3.

Figure 3:
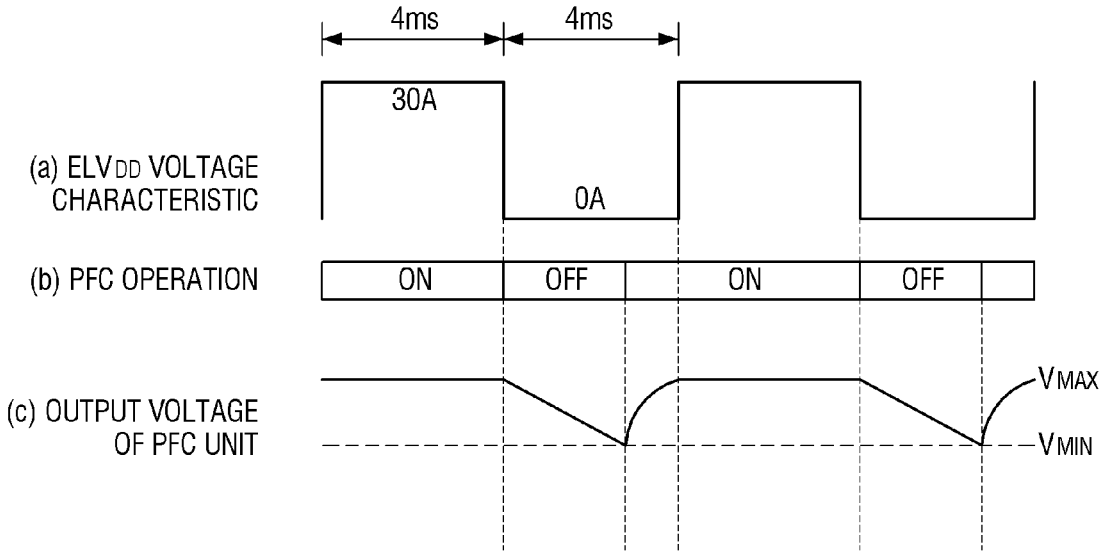

FIG. 3 is a timing diagram illustrating an operation characteristic of the PFC unit 221 according to an exemplary embodiment.

In detail, the timing diagram of FIG. 3 may include a characteristic (a) of a voltage ELVDD, an operation characteristic (b) of the PFC unit 221, and an output voltage (c) of the PFC unit 221.

Referring to the characteristic (a) of the voltage ELVDD, the voltage ELVDD is applied to have a second voltage level in a light-emitting section and a first voltage level in a data voltage charging section. The second voltage level in the light-emitting section is higher than the first voltage level in the data voltage charging section.

For the data voltage charging section, the scan driver 280 of the display apparatus which is the organic light-emitting display may supply a scan signal through the plurality of scan lines S1, S2, . . . , and Sn to turn on the switching transistor T1. Also, the data driver 270 of the display apparatus may supply a data signal through the plurality of data lines D1, D2, . . . , and Dm to charge the capacitor C of the plurality of pixels.

For the light-emitting section, the scan driver 280 of the display apparatus may cut the scan signal supplied through the plurality of scan lines S1, S2, . . . , and Sn and supply a voltage having a predetermined level through the voltage ELVDD to allow the driving transistor T2 to generate a driving current corresponding to a data voltage stored in the capacitor C and a threshold voltage in order to emit light from OLEDs. Here, the OLEDs may emit the light in response to the driving current.

Referring to the operation characteristic (b) of the PFC unit 221, the PFC unit 221 is turned off in the data voltage charging section in which a level of a DC voltage supplied to a display panel is a first voltage level. However, the PFC unit 221 is turned on in the light-emitting section in which the level of the DC voltage supplied to the display panel is a second voltage level. Also, the PFC unit 221 is turned on before a preset time from a time when the data voltage charging section ends.

Referring to the output voltage (c) of the PFC unit 221 if the PFC unit 221 is turned on, a predetermined DC voltage of the PFC unit 221 is supplied. If the PFC unit 221 is turned off, the PFC unit 221 includes the capacitor C and thus supplies the voltage level converter 230 with a voltage with which the capacitor C is charged. Therefore, a level of the charging voltage of the PFC unit 221 is lowered.

However, the output voltage of the PFC unit 221 may not be lower than or equal to the preset level Vmin. In other words, if the output voltage of the PFC unit 221 is lower than or equal to the preset level Vmin for the data voltage charging section, power efficiency of the voltage level converter 230, which has turned off the PFC unit 221, may be lower than efficiency of power passing through the voltage level converter 230 when the PFC unit 221 is turned on. Therefore, if the output voltage of the PFC unit 221 is lower than or equal to the preset level Vmin, the PFC unit 221 may be switched on according to a control command of the controller 250.

Elements of a display apparatus which is an organic light-emitting display according to an exemplary embodiment will now be described in more detail with reference to FIG. 4.

Figure 4:
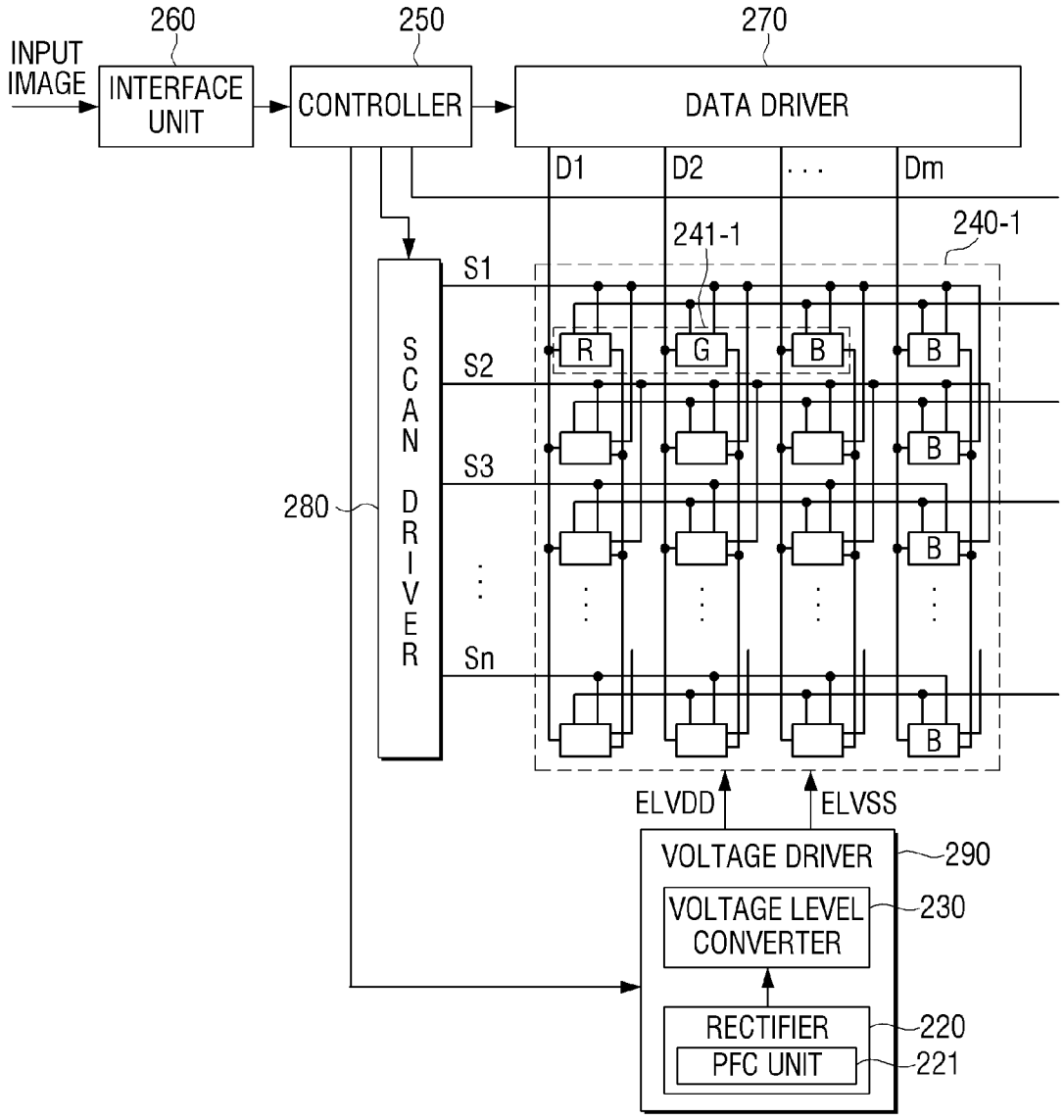
FIG. 4 is a block diagram illustrating a detailed structure of a display apparatus according to an exemplary embodiment.

FIG. 4 is a block diagram illustrating a detailed structure of a display apparatus according to an exemplary embodiment.

Before describing an operation of the display apparatus, the display apparatus may include a plurality of components 240-1, 240-2, . . . , and 240-n. The component 240-1 of the plurality of components 240-1, 240-2, . . . , and 240-n may be a display panel. Therefore, the component 240-1 will be described as a display panel in FIG. 4.

Referring to FIG. 4, the display apparatus includes an interface unit 260, the display panel 240-1, a controller 150, the data driver 270, the scan driver 280, and a voltage driver 290.

In general, the display apparatus which is an organic light-emitting display may be driven according to a passive matrix method or an active matrix method. The present exemplary embodiment explains that the display apparatus is driven according to the active matrix method. Also, the display apparatus which is the organic light-emitting display may display red (R), green (G), and blue (B) by using one of an independent pixel method, a color conversion method (CCM) and a color filtering method. The present exemplary embodiment explains that the display apparatus displays the R, G, and B through the independent pixel method.

The interface unit 260 may include a tuner which is to receive broadcast program contents from a broadcasting station, a Digital Visual Interface (DVI) connected to a recording medium player, a High Definition Multimedia Interface (HDMI) terminal, etc. The interface unit 260 receives an image signal having R, G, and B components from an external apparatus through these terminals and transmits the image signal to the controller 250. If the image signal is received, the controller 250 transmits the received image signal to the data driver 270.

The display panel 240-1 may include a plurality of pixels (hereinafter referred to as RGB pixels) 241-1 including OLEDs. The plurality of RGB pixels 241-1 may include self-emission elements which emit light in response to a flow of a current, a power supply source ELVDD which supplies the current to the self-emission elements, and driving transistors which control the current supplied to the self-emission elements. Here, the self-emission elements may be OLEDs, and the RGB pixels 241-1 may be respectively R, G, and B OLEDs. In other words, if the display apparatus displays RGB through the independent pixel method as described above, the display panel 240-1 may include a plurality of pixels which include R, G, and B OLEDs which are sequentially arranged.

The display panel 240-1 may include n scan lines S1, S2, . . . , and Sn which are arranged in a line direction to transmit a scan signal and m data lines D1, D2, . . . , and Dm which are arranged in a column direction to transmit a data signal. Also, the display panel 240-1 receives a driving power source ELVDD and a base power source ELVSS from the voltage driver 290 to be driven. For example, the display panel 240-1 may supply a current to the plurality of RGB pixels 241-1 through the scan signal, the data signal, the driving power source ELVDD, and the base power source ELVSS. Therefore, the plurality of RGB pixels 241-1 emit light in response to an amount of the current.

The data driver 270 receives the image signal having the R, G, and B components received from the controller 250 to generate the data signal. The data driver 270 is also connected to the data lines D1, D2, . . . , and Dm of the plurality of R, G, B pixels 241-1 to apply the data signal to the display panel 240-1.

The scan driver 280 is an element which performs an operation of generating the scan signal and is connected to the scan lines S1, S2, . . . , and Sn to transmit the scan signal to a particular line of the display panel 240-1. Therefore, the data signal output from the data driver 270 may be transmitted to the plurality of RGB pixels 241-1 to which the scan signal has been transmitted.

The voltage driver 290 includes a rectifier 220 and a voltage level converter 230 and transmits a generated driving voltage to the display panel 240-1 through the rectifier 220 and the voltage level converter 230. In detail, the voltage driver 290 may supply an OLED driving voltage to the plurality of RGB pixels 241-1 by using a DC voltage generated through the rectifier 220 and the voltage level converter 230 which have been described with reference to FIGS. 2 and 3. In other words, the voltage driver 290 may supply the driving power source ELVDD and the base power source ELVSS to R, G, and B OLEDs of the plurality of RGB pixels 241-1.

In detail, a PFC unit 221 of the rectifier 220 may correct a power factor of an input voltage and output the input voltage having the corrected power factor to the voltage level converter 230. In other words, if an AC voltage is input, the rectifier 220 rectifies the input AC voltage to generate a DC voltage. If the DC voltage is generated, the PFC unit 221 corrects a power factor of the rectified AC voltage and output the AC voltage having the corrected power factor to the voltage level converter 230.

The voltage level converter 230 converts the AC voltage output from the PFC unit 221 into at least one DC voltage. The voltage level converter 230 may also supply at least one DC voltage to the display panel 240-1. The scan driver 280 which supplies the DC voltage to the display panel 240-1 through the rectifier 220 and the voltage level converter 230, may supply the driving power source ELVDD and the base voltage source ELVSS to the plurality of RGB pixels 241-1 of the display panel 240-1 and may supply power to the elements of the display apparatus.

The controller 250 receives an image signal, a horizontal sync signal Hsync, a vertical sync signal Vsync, a main clock signal MCLK, etc. from an external apparatus through the interface unit 260 to generate an image data signal, a scan control signal, a data control signal, an emission control signal, etc. and transmits the image data signal, the scan control signal, the data control signal, the emission control signal, etc. to the display panel 240-1, the data driver 270, the scan driver 280, and the voltage driver 290. Detailed structures of these signals are obvious to those skilled in the art, and thus their detailed descriptions will be omitted.

The controller 250 which controls the elements of the display apparatus may control the rectifier 220 of the voltage driver 290 according to an operation state of the display panel 240-1. In detail, the controller 250 may turn off the PFC unit 221 of the rectifier 220 when the display panel 240-1 performs a data voltage charging operation but may turn on the PFC unit 221 when the display panel 240-1 performs a light emitting operation. In other words, if the controller 250 detects a level of a voltage ELVDD output from the voltage level converter 230 and, if the detected voltage level is a first voltage level, determines that the voltage ELVDD is in a data voltage charting section. If the detected voltage level is a second voltage level, the controller 250 determines that the voltage ELVDD is in a light emitting section.

If the controller 250 determines that the voltage ELVDD is in the data voltage charging section or the light emitting section according to the detected voltage level, the controller 250 may control a switching element of the PFC unit 221 to turn on/off the PFC unit 221.

The controller 250 may turn on the PFC unit 221 before a preset time from a time when the data voltage charging section ends or may turn on the PFC unit 221 if an output voltage of the PFC unit 221 is lower than or equal to a preset level when the PFC unit 221 is turned off. As described above, the controller 250 may control the switching element of the PFC unit 221 to perform an operation of turning on/off the PFC unit 221 in order to obtain a gain by power consumed by the PFC unit 221 for the data voltage charging section. Therefore, power efficiency may be more improved than in a conventional display apparatus. The operation of the controller 250 of controlling the switching element of the PFC unit 221 to turn on/off the PFC unit 221 has been described in detail with reference to FIGS. 2 and 3, and thus its detailed descriptions will be omitted hereinafter.

The plurality of components 240-1, 240-2, . . . , and 240-n may include infrared (IR) receiving modules, which are to receive an IR signal from a remote control apparatus, etc. The plurality of components 240-1, 240-2, . . . , and 240-n are driven by using the DC voltage input from the voltage level converter 230 of the voltage driver 290. However, the components 240-1, 240-2, . . . , and 240-n may be driven by a voltage lower than an OLED driving voltage, such as 1.1V. 1.8V, 3.3V, 5V, or the like. In this case, the components 240-1, 240-2, . . . , and 240-n may include additional voltage lowering circuit (not shown), which lower the input DC voltage, in order to lower a voltage supplied from the voltage level converter 230 to a used voltage level.

The voltage level converter 230 may further include a switching mode power supply (SMPS). In other words, the voltage level converter 230 may convert a DC voltage having an OLED driving voltage level into a voltage required by the components 240-2, . . . , and 240-n except the component 240-1 which is the display panel, through the SMPS and output the voltage. The SMPS may include a voltage converter to induce a DC voltage having various levels to a secondary winding wire according to a winding wire ratio if a DC voltage having a level for driving OLEDs is applied to a primary winding wire of the voltage converter. Through this process, the SMPS may output various DC voltages of 1.1V, 1.8v, 3.3V, 5V, etc. to supply the various DC voltages to the components 240-1, 240-2, . . . , and 240-n.

According to an exemplary embodiment, as described above, a driving voltage may be further efficiently applied to the components 240-1, 240-2, . . . , and 240-n of the display apparatus by using one DC-DC converter.

An OLED is a light-emitting device which emits light at a driving voltage between 12V and 15V. Therefore, if the RGB pixel 241-1 of the display panel 240-1 is realized as an OLED, and a liquid crystal display (LCD) emits light by using a backlight unit, the component 240-1 which is the display panel may be driven at a voltage lower than a voltage between 200V and 300V. The components 240-1, 240-2, . . . , and 240-n of the display apparatus are generally driven at a voltage lower than or equal to an OLED driving voltage. In other words, since the OLED driving voltage is similar to the voltage for driving the components 240-1, 240-2, . . . , and 240-n, the driving voltage of the components 240-1, 240-2, . . . , and 240-n may be generated through one DC-DC converter.

A circuit configuration of the RGB pixel 241-1 of the display panel 240-1 of the display apparatus will now be described in detail.

Figure 5:
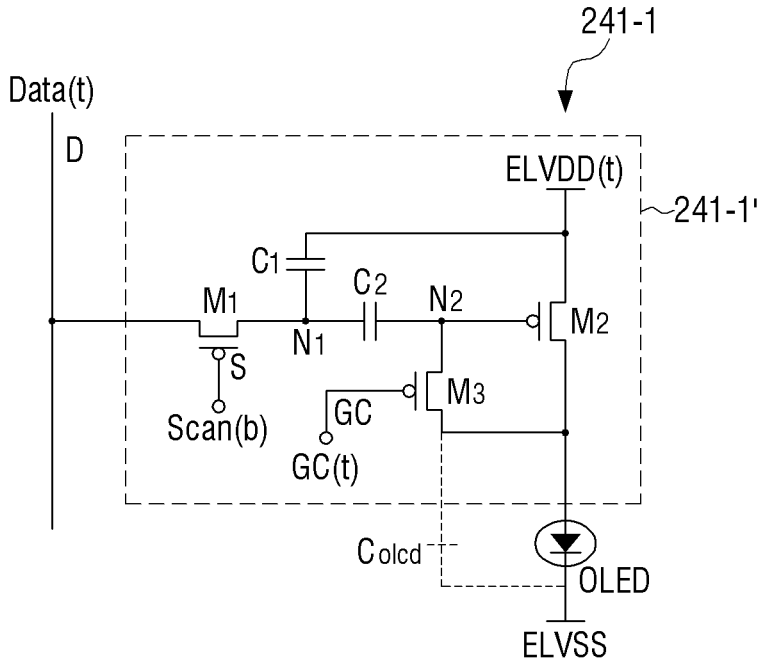
FIG. 5 is a circuit diagram of RGB pixels of a display panel according to an exemplary embodiment.

FIG. 5 is a circuit diagram of an RGB pixel of a display panel according to an exemplary embodiment.

Referring to FIG. 5, each RGB pixel 241-1 of the display panel 240-1 includes an OLED and a pixel circuit 241-1' which is to supply a current to the OLED.

An anode of the OLED is connected to the pixel circuit 241-1', and a cathode of the OLED is connected to a second power source ELVSS. The OLED generates light having predetermined brightness in response to the current supplied from the pixel circuit 241-1'. As shown in FIG. 5, the pixel circuit 241-1' of the RGB pixel 241-1 may include three transistors, i.e., first, second, and third transistors, M1, M2, and M3, and two capacitors, i.e., first and second capacitors, C1 and C2. Here, a gate electrode of the first transistor M1 is connected to a scan line S, a first electrode of the first transistor M1 is connected to a data line D, and a second electrode of the first transistor M1 is connected to a first node N1.

In other words, a scan signal Scan (b) is input into the gate electrode of the first transistor M1, and a data signal Data (t) is input into the first electrode of the first transistor M1. Also, a gate electrode of the second transistor M2 is connected to a second node N2, a first electrode of the second transistor M2 is connected to a first power source ELVDD(t), and a second power source is connected to an anode of an OLED. Here, the second transistor M2 operates as a driving transistor.

The first capacitor C1 is connected between the first node N1 and the first electrode of the second transistor M2, i.e., the first power source ELVDD (t), and the second capacitor C2 is connected between the first node N1 and the second node N2. Also, a gate electrode of the third transistor M3 is connected to a control line GC, a first electrode of the third transistor M3 is connected to the gate electrode of the second transistor M2, and a second electrode of the third transistor M3 is connected to the anode of the OLED, i.e., the second electrode of the second transistor M2.

Therefore, a control signal GC (t) is input into the gate electrode of the third transistor M3. If the third transistor M3 is turned on, the second transistor M2 is connected to a diode, and a cathode of the OLED is connected to the second power source ELVSS (t).

A power supplying apparatus which supplies power to a display panel including a plurality of RGB pixels including OLEDs according to exemplary embodiments will now be described in detail.

Figure 6:
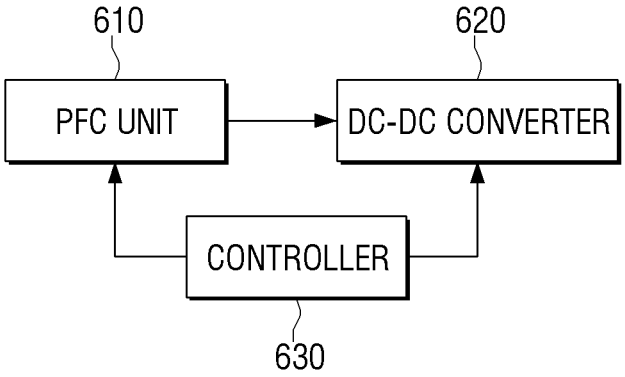
FIG. 6 is a block diagram of a power supplying apparatus which supplies power to a display panel including a plurality of RGB pixels having organic light-emitting diodes (OLEDs), according to an exemplary embodiment.

FIG. 6 is a block diagram of a power supplying apparatus which supplies power to a display panel including a plurality of RGB pixels including OLEDs according to an exemplary embodiment.

Referring to FIG. 6, the power supplying apparatus includes a PFC unit 610, a DC-DC converter 620, and a controller 630. As shown in FIG. 4, the power supplying apparatus may be used in a display apparatus including a display panel 240-1 including a plurality of pixels including OLEDs. Here, the display apparatus may be an organic light-emitting display.

The power supplying apparatus which supplies power to the display panel 240-1 of the display apparatus may supply power sources ELVDD and ELVSS. Here, the power supplying apparatus may supply the power sources ELVDD and ELVSS and may supply a driving power source to all elements of the display apparatus requiring a power source.

The PFC unit 610 corrects a power factor of an input voltage and outputs the input voltage having the corrected power factor to the DC-DC converter 620. In other words, if an input AC voltage is rectified to be generated as a DC voltage through the rectifier 220 as illustrated in FIG. 3 or 4, the PFC unit 610 may correct a power factor of the rectified DC voltage and output the DC voltage having the corrected power factor to the DC-DC converter 620. In general, an output of the PFC unit 610 may be about 400V in the display apparatus which is an organic light-emitting display.

Here, the PFC unit 610 is a power saving circuit added to improve power efficiency of the power supplying apparatus and adjusts power supplied to components, such as a transformer, a stabilizer, etc., which may instantaneously leak power. In other words, the PFC unit 610 may reduce power consumption and prevent a temperature from rising due to a change of a current into heat in order to improve power efficiency.

In detail, the PFC unit 610 may include an inductor, a diode, a capacitor, and a switching means. Here, the inductor and the capacitor may be respectively connected to both ends of the diode, and the switching means may be connected to a contact node between the inductor and the diode and may be used as a transistor. A detailed circuit diagram of the PFC unit 610 will be omitted. The PFC unit 610 may be a boost topology.

The DC-DC converter 620 converts a level of the DC voltage output from the PFC unit 610. As shown in FIG. 4, the DC-DC converter 620 may supply the DC voltage having the converted level to the display panel 240-1 of the display apparatus. Here, the DC-DC converter 620 may be constituted by using a well-known DC-DC converter circuit. The controller 630 controls an overall operation of the power supplying apparatus. In detail, the controller 630 may control the PFC unit 610 and the DC-DC converter 620.

The controller 630 may control turning on/off of the PFC unit 610 according to an operation state of the display panel 240-1. In other words, the controller 630 may turn off the PFC unit 610 when the display panel 240-1 performs a data voltage charging operation. However, the controller 630 may turn on the PFC unit 610 when the display panel 240-1 performs a light-emitting operation.

Here, as shown in FIG. 4, a data voltage charging section in which the display panel 240-1 performs the data voltage charging operation refers to a section in which the scan driver 280 of the display apparatus supplies a scan signal through a plurality of scan lines S1, S2, . . . , Sn-1, and Sn to turn on a switching transistor T1, and the data driver 270 of the display apparatus supplies a data signal through a plurality of data lines D1, D2, Dm-1, and Dm to charge a capacitor C of a plurality of pixels. Here, the capacitor C stores the supplied data signal as a data voltage.

A voltage ELVDD supplied from the DC-DC converter 620 to the plurality of pixels of the display panel 240-1 for the data voltage charging section may be a first voltage level.

The light-emitting section in which the display panel 240-1 emits light refers to a section in which the scan driver 280 of the display apparatus cuts the scan signal supplied through the plurality of scan lines S1, S2, . . . , and Sn-1, and Sn and supplies a voltage having a predetermined level through the voltage ELVDD to allow a driving transistor T2 to generate a driving current corresponding to the data voltage stored in the capacitor C and a threshold voltage in order to emit light from an OLED. Here, the OLED emits the light in response to the driving current.

The voltage ELVDD supplied from the DC-DC converter 620 to the plurality of pixels of the display panel 240-1 for the light-emitting section may be a second voltage level. In other words, the controller 630 may detect a level of the voltage ELVDD output from the DC-DC converter 620 and, if the detected voltage level is a first voltage level, may determine that the voltage ELVDD is in the data voltage charging section. The controller 630 may detect a level of the voltage ELVDD output from the DC-DC converter 620 and, if the detected voltage level is a second voltage level, may determine that the voltage ELVDD is in the light emission section.

If the controller 630 determines that the voltage ELVDD is in the data voltage charging section, the controller 630 may turn off the PFC unit 610. If the controller 630 determines that the voltage ELVDD is in the emission section, the controller 630 may turn on the PFC unit 610. In other words, the controller 630 may control the switching element of the PFC unit 610 to control turning on/off of the PFC unit 610.

As described above, the controller 630 may control the PFC unit 610 to be turned off in the data voltage charging section to obtain a gain in power consumed by the PFC unit 610 for the data voltage charting section. In other words, if a conventional voltage supplying apparatus is applied, the conventional voltage supplying apparatus does not reflect a driving characteristic of a display apparatus which is an organic light-emitting apparatus (i.e., a characteristic by which a current is not supplied to an OLED in the data voltage charging section but is supplied to the OLED in the emission section). Therefore, the PFC unit 610 operates in the data voltage charging section, and thus an unnecessary loss of power occurs. Accordingly, the power supplying apparatus according to an exemplary embodiment may improve power efficiency.

The controller 630 may turn on the PFC unit 610 before a preset time from a time when the data voltage charging section ends. In other words, the controller 630 turns off the PFC unit 610 for the data voltage charging section. In this case, the PFC unit 610 includes a capacitor and supplies a voltage, with which the capacitor is charged, to the DC-DC converter 620. Therefore, a level of the charging voltage of the PFC unit 610 is lowered. If the voltage ELVDD reaches the light-emitting section, the PFC unit 610 is turned on, and thus a time is required for an output of the PFC unit 610 to reach a preset voltage level. Therefore, the controller 630 may turn on the PFC unit 610 before a preset time (i.e., before a time when a voltage level reaches a preset level at a starting time of the light-emitting section) from the time when the data voltage charging section ends.

If the output voltage of the PFC unit 610 is lower than or equal to a preset level when the PFC unit 610 is turned on, the controller 630 may control the PFC unit 610 to be turned on. In other words, if the output voltage of the PFC unit 610 is lower than or equal to a preset level Vmin for the data voltage charging section, power efficiency of the DC-DC converter 620 which has turned on the PFC unit 610 may be lower than efficiency of power passing through the DC-DC converter 620 when the PFC. unit 610 is turned on. Therefore, if the output voltage of the PFC unit 610 is lower than or equal to the preset level Vmin, the controller 630 may control the PFC unit 610 to be turned on.

The elements of the display apparatus and the power supplying apparatus according to an exemplary embodiment have been described in detail. A method of supplying from a power supplying apparatus to a display panel including a plurality of pixels including OLEDs of a display apparatus will now be described in detail.

Figure 7:
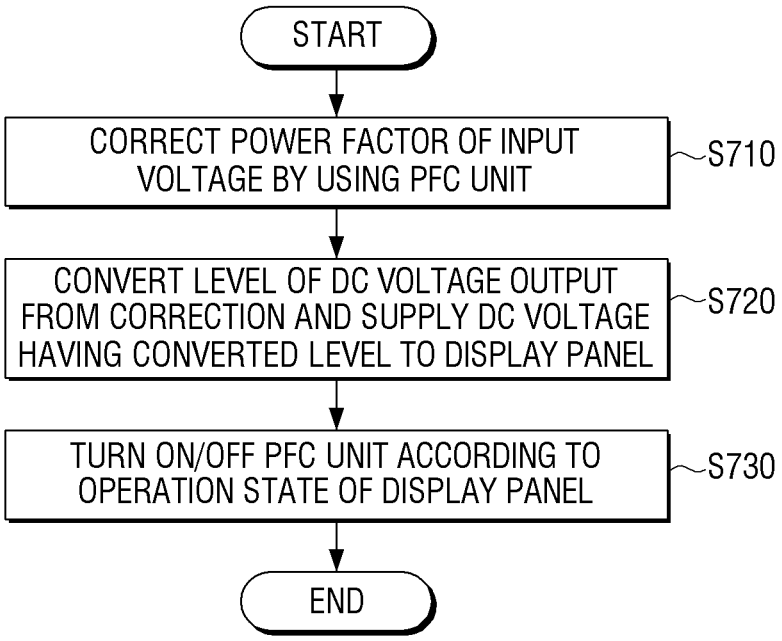
FIG. 7 is a flowchart illustrating a method of supplying power from a power supplying apparatus to a display apparatus including a display panel having a plurality of pixels having OLEDs, according to an exemplary embodiment.

FIG. 7 is a flowchart illustrating a method of supplying from a power supplying apparatus to a display panel including a plurality of pixels including OLEDs of a display apparatus according to an exemplary embodiment.

Referring to FIG. 7, in operation S710, the power supplying apparatus corrects a power factor of an input voltage by using a PFC unit. In operation S720, the power supplying apparatus converts a level of a DC voltage, which is output through the correction of the power factor of the input voltage, and supplies the DC voltage having the converted level to the display panel. In operation S730, the power supplying apparatus controls the PFC unit to be turned on/off according to an operation state of the display panel. The method will now be described in more detail with reference to FIG. 8.

Figure 8:
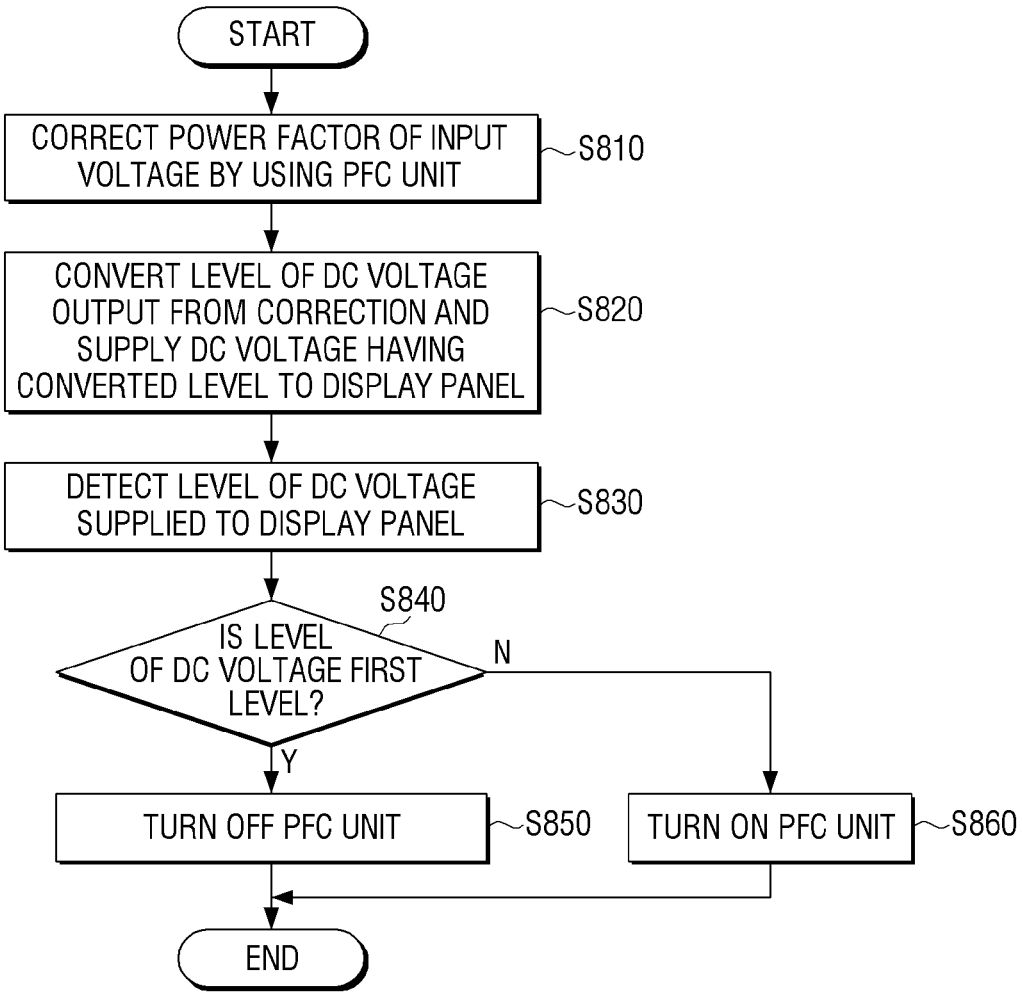
FIG. 8 is a flowchart illustrating a method of supplying power from a power supplying apparatus to a display apparatus, according to an exemplary embodiment.

FIG. 8 is a flowchart illustrating a method of supplying power from a power supplying apparatus to a display apparatus according to an exemplary embodiment.

Referring to FIG. 8, in operation S810, the power supplying apparatus corrects a power factor of an input voltage through a PFC unit. If a DC voltage of the input voltage is output through the correction of the power factor of the input voltage, the power supplying apparatus converts a level of the output DC voltage and supplies the DC voltage having the converted level to a display panel of the display apparatus in operation S820. In operation S830, the power supplying apparatus detects a level of the DC voltage supplied to the display panel. In operation S840, the power supplying apparatus checks whether the detected level of the DC voltage is a first level. If it is checked that the detected level of the DC voltage is the first level, the power supplying apparatus determines that the display panel performs a data voltage charging operation to turn off the PFC unit in operation S850. If it is checked that the detected level of the DC voltage is not the first level, the power supplying apparatus determines that the detected level of the DC voltage is a second level. Therefore, in operation 5860, the power supplying apparatus determines that the display panel performs a light-emitting operation to turn on the PFC unit.

As described above, a power supplying apparatus, which turns on/off a PFC unit according to a level of a DC voltage supplied to a display panel, may turn on the PFC unit before a preset time from a time when a data voltage charging section ends. Also, if an output voltage of the PFC unit is lower than or equal to a preset level when the PFC unit is turned off, the power supplying apparatus may turn on the PFC unit.

According to the above-described various exemplary embodiments, a power supplying apparatus turns off a PFC unit in a data voltage charging section to obtain a gain in power consumed by the PFC unit for the data voltage charging section. Therefore, power efficiency may be improved. A power supplying apparatus, a power supplying method, and an organic light-emitting display according to exemplary embodiments have been described in detail.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An organic light-emitting diode (OLED) display apparatus comprising:

a plurality of components which are to perform an operation of the OLED display apparatus;

a power supplier;

a rectifier which comprises a power factor correction (PFC) unit and rectifies an input voltage supplied from the power supplier;

a voltage level converter which converts a level of the input voltage rectified by the rectifier and supplies the input voltage having the converted level to the plurality of components; and a controller which controls the PFC unit to be turned on/off according to operation states of the plurality of components, wherein the controller turns off the PFC unit when the display panel performs a data voltage charging operation and turns on the PFC unit when the display panel performs a light emitting operation.

2. The OLED display apparatus of claim 1, wherein the voltage level converter converts a level of a direct current (DC) voltage output from the PFC unit into a voltage level for driving a display panel and supplies the DC voltage having the voltage level to the plurality of components.

3. The OLED display apparatus of claim 2, wherein the display panel comprises a plurality of pixels comprising OLEDs.

4. The OLED display apparatus of claim 1, wherein the controller detects a level of the DC voltage supplied to the display panel, and if the detected level of the DC voltage is a first voltage level, determines that the display panel performs the data voltage charging operation to turn off the PFC unit, and if the detected level of the DC voltage is a second voltage level, determines that the display panel performs the light emitting operation to turn on the PFC unit.

5. The OLED display apparatus of claim 4, wherein the controller turns on the PFC unit before a preset time based on a time when a data voltage charging operation ends.

6. The OLED display apparatus of claim 4, wherein if an output voltage of the PFC unit is lower than or equal to a preset level when the PFC unit is turned off, the controller determines that the preset time has elapsed and turns on the PFC unit.

7. The OLED display apparatus of claim 1, further comprising:

a scan driver which supplies a scan signal to the plurality of pixels;

a data driver which supplies a data signal to the plurality of pixels; and a voltage driver which supplies a driving voltage to the display panel.

8. The OLED display apparatus of claim 1, wherein the plurality of components comprise at least one from among a display panel, an audio amplifier, a communication interface module, and a sub Micom.

9. A power supplying apparatus which supplies power to a display panel comprising a plurality of pixels comprising OLEDs, the power supplying apparatus comprising:

a power factor correction (PFC) unit which corrects a power factor of an input voltage;

a DC-DC converter which converts a level of a DC voltage output from the PFC unit and supplies the DC voltage having the converted level to the display panel; and a controller which controls the PFC unit to be turned on/off according to an operation state of the display panel, wherein the controller turns off the PFC unit when the display panel performs a data voltage charging operation and turns on the PFC unit when the display panel performs a light emitting operation.

10. The power supplying apparatus of claim 9, wherein the controller detects a level of the DC voltage supplied to the display panel, and if the detected level of the DC voltage is a first voltage level, determines that the display panel performs the data voltage charging operation to turn off the PFC unit, and if the detected level of the DC voltage is a second voltage level, determines that the display panel performs the light emitting operation to turn on the PFC unit.

11. The power supplying apparatus of claim 9, wherein the controller turns on the PFC unit before a preset time based on a time when the data voltage charging operation ends.

12. The power supplying apparatus of claim 11, wherein if an output voltage of the PFC unit is lower than or equal to a preset level when the PFC unit is turned off, the controller determines that the preset time has elapsed and turns on the PFC unit.

13. A method of supplying power to a display panel comprising a plurality of pixels comprising OLEDs, the method comprising:

correcting a power factor of an input voltage by using a power factor correction (PFC) unit;

converting a level of a DC voltage output through the correction and supplying the DC voltage having the converted level to the display panel; and turning on/off the PFC unit according to an operation state of the display panel, wherein the turning on/off of the PFC unit comprises:

turning off the PFC unit when the display panel performs a data voltage charging operation; and turning on the PFC unit when the display panel performs a light emitting operation.

14. The method of claim 13, wherein the turning on/off of the PFC unit further comprises:

detecting a level of the DC voltage supplied to the display panel, wherein if the detected level of the DC voltage is a first voltage level, a determination is made that the display panel performs the data voltage charging operation to turn off the PFC unit, and if the detected level of the DC voltage is a second voltage level, a determination is made that the display panel performs the light emitting operation to turn on the PFC unit.

15. The method of claim 13, wherein the PFC unit is turned on before a preset time based on a time when a data voltage charging operation ends.

16. The method of claim 15, wherein if an output voltage of the PFC unit is lower than or equal to a preset level when the PFC unit is turned off, a determination is made that the preset time has elapsed to turn on the PFC unit.

* * * * *